United States Patent [19]

Milne et al.

[11] Patent Number: 5,044,589

[45] Date of Patent: Sep. 3, 1991

[54] VERTICAL WALL COVERING BRACKET ASSEMBLY

[76] Inventors: Fred W. Milne, 25422 Trabuco Rd., No. 105-154, El Toro, Calif. 92630; Rolf Hess, 501 Park Industrial Dr., La Habra, Calif. 90631

[21] Appl. No.: 542,767

[22] Filed: Jun. 25, 1990

[51] Int. Cl.[5] ..... A47H 1/10

[52] U.S. Cl. ..... 248/265; 160/902

[58] Field of Search ..... 248/269, 257, 345, 256, 248/258, 270, 307, 316.4, 208, 231.4, 297.2, 295.1, 316.1, 225.31, 298, 265; 403/104, 109, 377, 381; 160/902

[56] References Cited

U.S. PATENT DOCUMENTS

| | | | |
|---|---|---|---|
| 302,060 | 7/1884 | Vaas | 248/265 |
| 2,371,903 | 3/1945 | Maier | 248/231.4 |
| 3,030,060 | 4/1962 | Breuer | 248/316.4 |
| 4,022,415 | 5/1977 | Roderick et al. | 248/298 |
| 4,120,474 | 10/1978 | Hurley | 248/265 |
| 4,140,294 | 2/1979 | Zwarts | 248/265 |
| 4,179,091 | 12/1979 | Bidney | 248/265 |
| 4,363,459 | 12/1982 | Holzer | 248/265 |

*Primary Examiner*—Carl D. Friedman
*Assistant Examiner*—Korie H. Chan
*Attorney, Agent, or Firm*—George J. Netter

[57] ABSTRACT

A bracket assembly for adjustably positioning a window covering headrail having a first L-shaped bracket part for wall mounting that slidingly fits on a second bracket part secured to the headrail. Projections on the second bracket part slide along grooves in the first bracket part and resist removal from the grooves by frictionally engaging the groove ends.

4 Claims, 2 Drawing Sheets

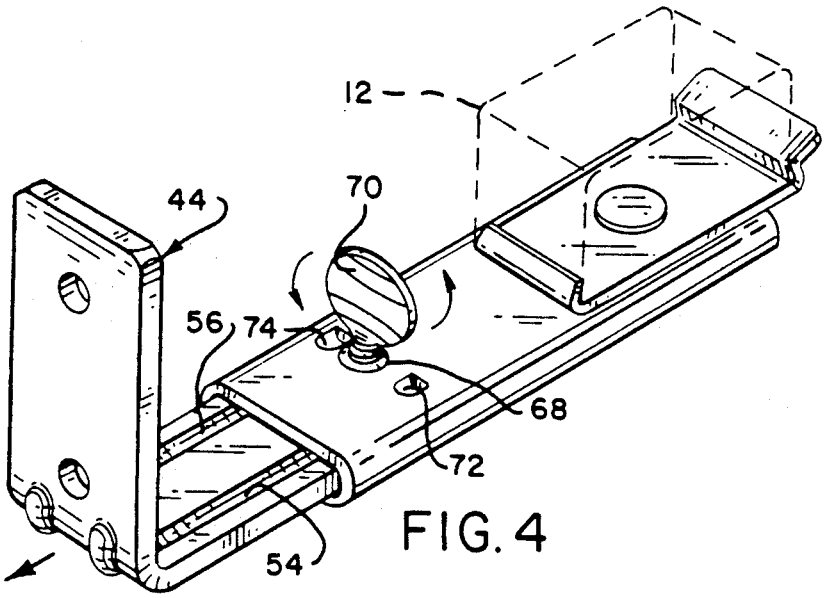
FIG. 4
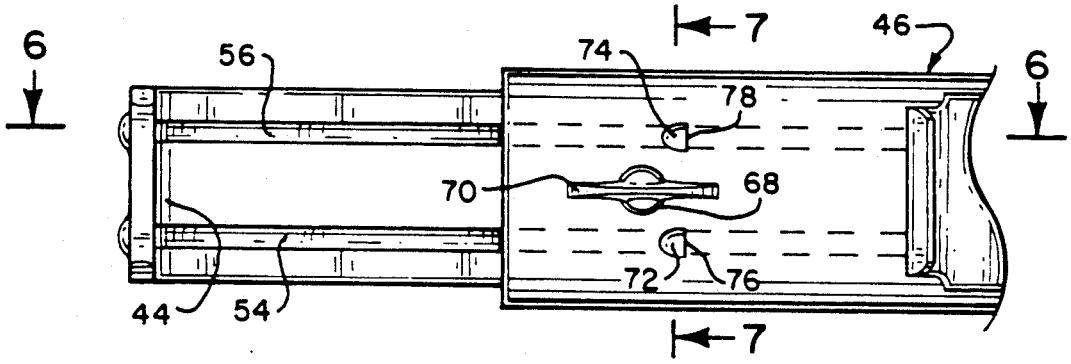
FIG. 5
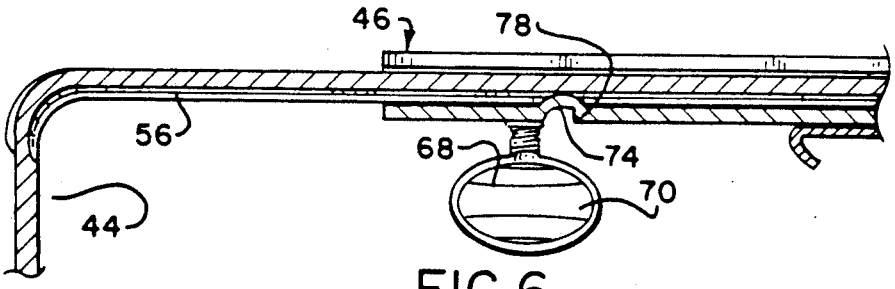
FIG. 6
FIG. 7
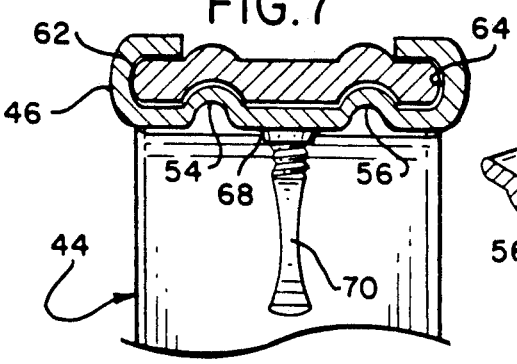
FIG. 8
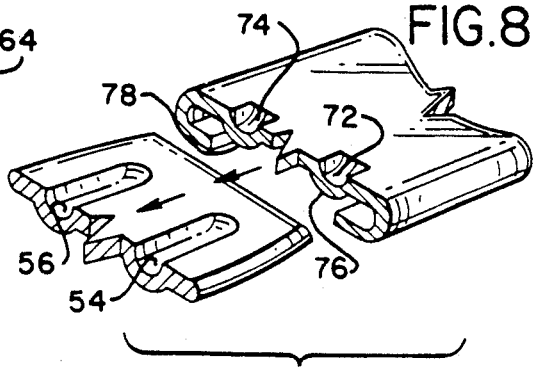

VERTICAL WALL COVERING BRACKET ASSEMBLY

BACKGROUND OF THE INVENTION

1. Field of the Invention

The present invention pertains generally to an adjustable wall bracket assembly for a vertical wall covering, and, more particularly, to such a bracket assembly the bracket parts of which become captive on assembly.

2. Related Art

A vertical wall covering with which the present invention is most advantageously employed consists of, in one form, a length of pleated material attached to a headrail for hanging relation thereto. The headrail, in turn, is mounted to either the ceiling or sidewall of a room such that the pleated material hangs down as a wall covering or a covering for a window, most typically. Adjustment devices are provided for opening and closing the pleated material by raising it to control visibility, as well as controlling the amount of light that may come from a window covered by the unit. A headrail is connected to the wall or ceiling surface by two or more brackets which must be adjustable in order to properly position the wall covering in both a satisfactorily functioning relation as well as for aesthetics.

The most commonly encountered bracket for use in this connection has two parts, one of a general L-shaped and a second piece which can be slidingly fit onto one of the arms of the first piece. A slotted opening in the L-shaped member accommodates a threaded bolt therethrough. In use, the L-shaped part is affixed to a wall or ceiling, as the case may be, and the other member is secured to the wall covering headrail. The two bracket members are then adjustably related to one another and secured together by a nut and bolt, for example, to form a unitary assembly.

The difficulty in using a bracket of this kind is that the two parts can become disengaged when initially trying to properly position the headrail and tighten the bolt onto the bracket parts. It is accordingly desirable to have a bracket assembly which will generally maintain the overall desired geometry and relationship of the bracket parts while adjustment and mounting is taking place.

Although the invention has been described in connection with a vertical wall covering, sometimes referred to as a vertical blind, it can also apply with equal advantage to the mounting of a so-called venetian blind and as well can be used in mounting certain kind of valances used with conventional drapes for example.

SUMMARY OF THE INVENTION

The bracket assembly of the invention to be described includes an elongated, rectangular plate member, the long sides of which are formed inwardly a slight mount onto spaced from the same major surface, thereby forming two elongated guide channels. Adjacent one end is an opening via which a rivet, screw or bolt can be affixed for interconnecting this rectangular plate member to the headrail of a window covering unit. Spaced longitudinally from the first opening is a second opening adjacent the opposite end. First and second spaced apart projections extend upwardly from the major surface of the plate member member, one at each side of the second opening, and having a portion that is pierced and facing back towards the first opening.

A bracket member is generally L-shaped with a first arm including several openings through which mounting screws or bolts pass for affixing the L-shaped bracket member to a wall surface. The second arm of the L-shaped member includes a pair of elongated grooves formed on what is the inner surface of the L-shaped member which grooves are parallel to one another and of a dimension spaced apart identical, to that or the pierced projections on the plate member. The grooves terminate at a point spaced from the outer end of the L-shaped member second arm.

In assembly, the L-shaped bracket member second arm having the grooves therein is slid into the receiving space of the plate member defined by the formed edges so that the second arm is held by the formed edges. The two parts have to be forced together until the projections are located within the grooves at which time the pierced edges of the projections cannot be forced back out of the grooves and the two parts are held captive to one another.

BRIEF DESCRIPTION OF THE DRAWING

In the accompanying drawings:

FIG. 4 is a further perspective view of the bracket assembly of this invention which is shown inverted from the depiction in FIG. 3;

FIG. 5 is a plan view of the bracket of this invention;

FIG. 6 is a side elevational, sectional view taken along the line 6—6 of FIG. 5;

FIG. 7 is a transverse elevational, sectional view taken along the line 7—7 of FIG. 5; and FIG. 8 is a fragmentary view showing the bracket assembly parts in separated view immediately prior to assembly.

DESCRIPTION OF A PREFERRED EMBODIMENT

Figure 1:
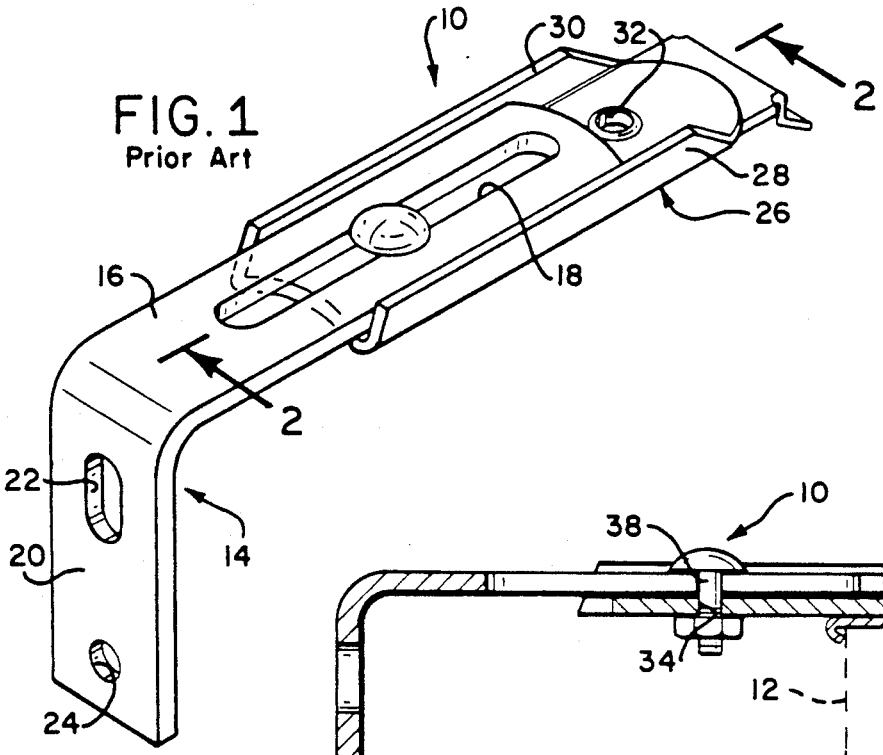
FIG. 1 Prior Art
FIG. 1 is a perspective view of a prior art bracket.
Figure 2:
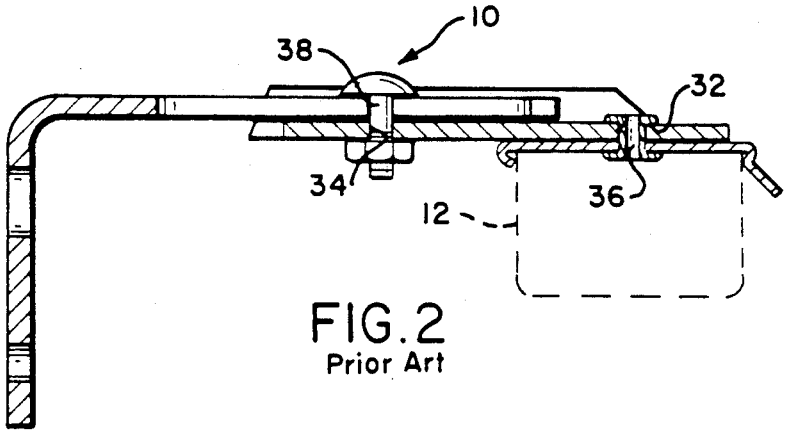
FIG. 2 Prior Art
FIG. 2 is a side elevational, sectional view taken along the line 2—2 of FIG. 1.
Figure 3:
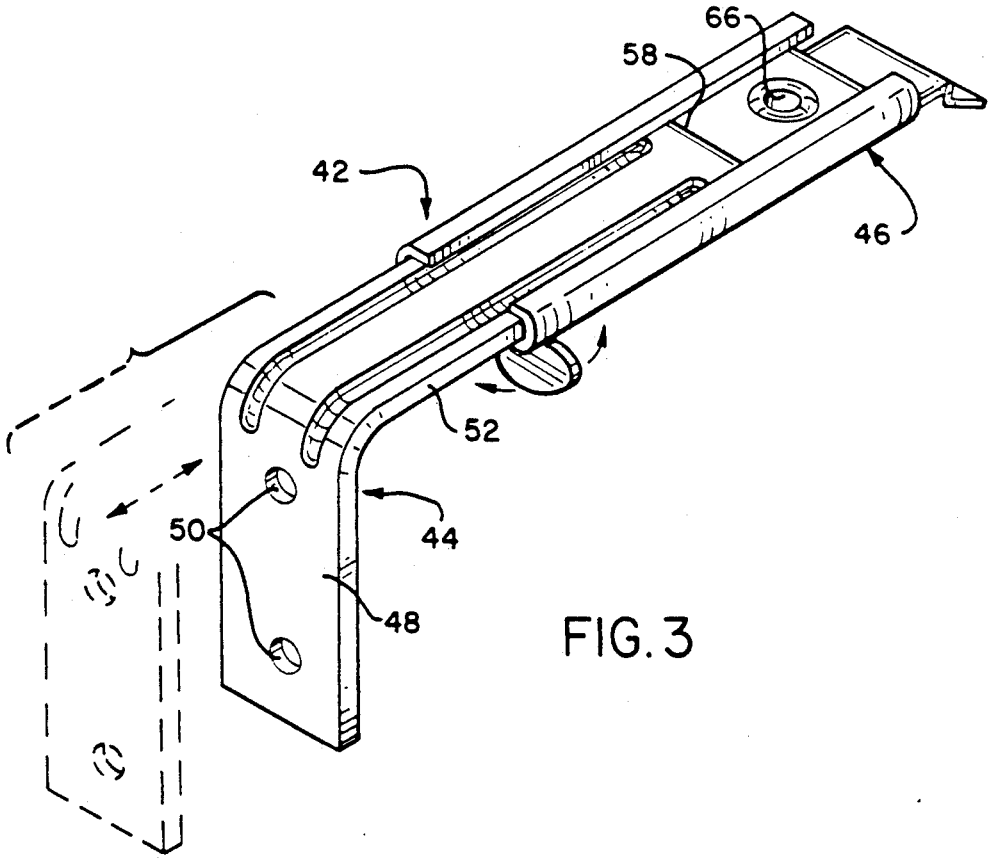
FIG. 3 is a perspective view of the bracket assembly of the present invention.

Turning now to the drawings and particularly FIGS. 1 and 2, there is depicted a prior art bracket assembly 10 for hanging the headrail 12 of a wall covering unit onto a wall or ceiling of a room (not shown). The bracket assembly 10 includes a first L-shaped bracket part 14 having a first arm 16 that has an elongated slot 18, and a second arm 20 having one or more openings 22 and 24 therein. A second bracket part 26 is generally elongated and has upstanding edge walls 28 and 30 defining a space therebetween for sliding receipt of the first bracket part 14 therebetween. First and second openings 32 and 34 are provided adjacent opposite ends of the second part 26 for receiving a rivet 36 to secure the headrail thereto and for receiving a threaded adjustment bolt 38, respectively.

In use of the prior art bracket assembly 10, the headrail 12 for the wall covering unit is secured to what will be the lower surface of the bracket arm 26 by the rivet 36 or other conventional fastener such as a screw and nut for example. The L-shaped arm 14 is secured to, say, a vertical wall surface by screws or bolts (not shown) passing through the openings 22 and 24 in order to locate the bracket (and headrail) at the desired position such as, for example, immediately above a window.

Then the two bracket parts 14 and 26 are joined together along with the headrail with or without the hanging portion. The bolt 38 is passed through the elongated slot 18 and opening 34 and secured by a nut 40 in order to properly locate the two parts and the headrail at the desired spacing from the wall. This turns out to be a rather complicated and sometimes very difficult operation because of the necessity for manipulating the weight and bulkiness of the headrail as well as the hanging portion of the wall covering unit. Since the two bracket parts 26 and 14 can be totally separated from one another, there is always the possibility, when joining the two together and adjusting the nut 38, that the parts can become separated and dropped or at least hang at a large angle during mounting which makes it difficult to attain the desired adjustment.

For the ensuing detailed description of the bracket assembly of this invention, reference is now made simultaneously to FIGS. 3 through 8. The bracket assembly enumerated as 42 includes a first generally L-shaped part 44 which is slidingly assembled onto a second elongated part 46 and is held captive thereto in a way that will be described. The first bracket part 44 is constructed of an elongated rectangular piece of metal formed into a generally L-shape configuration. A first arm 48 is smooth and flat and includes one or, preferably, several openings 50 via which screws or bolts (not shown) can affix the part 44 to a wall surface in conventional manner. The second arm 52 has a pair of spaced apart parallel grooves that extend longitudinally of the arm, and parallel to the second arm lateral edges. The two grooves are spaced inwardly from the arm edges and terminate at a point short of the outermost arm end 58. The grooves 54 and 56 face outwardly from the same major surface of the arm 52 and, namely, toward the inner part of the L-shaped bracket part.

The second bracket part 46 consists of an elongated generally rectangular metal plate having the two edge portions folded back over the same major surface of the plate to defining guide channels 62 and 64 which face one another and extend completely along the bracket part plate edge. Adjacent one end of what will be the outer end of the second bracket part 46 is an opening 66 via which the rivet 36 (or other connecting means such as a bolt) is received for securing the headrail 12 in the same manner as shown in FIG. 2, for example. Adjacent the opposite or inner end 68 of the second bracket part 46, there is a further opening 68 (FIG. 4) within which a thumb screw 70 is threaded.

At each side of the opening 68, there is located a deformation or projection 72 and 74, respectively, which extend outwardly from the major surface of the second part into the area between the facing guide channels 62 and 64. More particularly, these projections 72 and 74 are formed by piercing the plate with a pierced edges 76 and 78 facing toward the opening 66.

To assemble the second bracket part 46 onto the L-shaped part 44, the end 58 of the L-shaped part is slidingly received within the guide channels 62 and 64 with the opening 68 and wing nut 70 at the leading end of the part 46. Initially, the projections 72 and 74 frictionally engage the outer surface of the second arm 52 of the L-shaped part lying between the end 58 and the terminations of the two grooves 54 and 56. Continued movement of the two bracket parts together finally brings the projections to the point where they are received within the grooves 54 and 56 and now the two parts can be freely moved together or part, as desired with the projections traveling smoothly along the grooves. However, once the projections are located within the grooves, any attempt to remove the second connector bracket part 46 from the part 44 is prevented by the pierced end faces 76 and 78 of the projections which dig into the metal as the projections attempt to leave the groove ends.

What is claimed is:

1. A bracket assembly for adjustably locating a window covering headrail at a desired spacing from a wall surface, comprising:

a first bracket part formed into a generally L-shaped body including first and second arms, said first arm having at least one opening for receiving means to secure said first arm to wall surface, and said second arm including a pair of spaced apart grooves extending along the second arm away from the first arm to a point short of the second arm edge and both grooves having their respective concave parts facing inwardly of the L-shaped body in the same direction as the first arm;

a second bracket part of generally rectangular shape with guide channels extending along two opposite sides for slidingly receiving edges of the first bracket part second arm therein, and first and second openings in said second bracket located respectively adjacent opposite ends of said second bracket between the guide channels;

a pair of projections on the second bracket part surface facing the second arm of the first bracket part, said projections located to be received within respective grooves of the first bracket part second arm and extending to such an extent that they will frictionally engage a surface on the first bracket part second arm during assembly of the first and second bracket parts together until the projections are positioned opposite respective grooves in the second arm at which time the projections are free from contact with a second arm surface; and a selectively releasable means threaded within the opening of the second bracket part closer to the first bracket part first arm.

2. A bracket assembly as in claim 1, in which the releasable means is a thumb screw.

3. A bracket assembly as in claim 1, in which the guide channels include opposite edge portions of the second bracket formed onto and spaced for the same bracket part surface.

4. A bracket assembly for adjustably locating a window covering headrail at a desired spacing from a wall surface, comprising:

a first bracket part formed into a generally L-shaped body including first and second arms, said first arm having at least one opening for receiving means to secure said first arm to a wall surface, and said second arm including a pair of spaced apart grooves extending along the second arm away from the first arm and both grooves having their respective concave parts facing inwardly of the L-shaped body in the same direction as the fist arm;

a second bracket part of generally rectangular shape with guide channels extending along two opposite sides for slidingly receiving edges of the first bracket part second arm therein, and first and second openings in said second bracket located respectively adjacent opposite ends of said second bracket between the guide channels;

a pair of projections on the second bracket part surface facing the second arm of the first bracket part formed by piercing to provide pierced edges facing away from the first bracket part first arm to prevent backing-out of the projection from the grooves, said projection located to be received within respective grooves of the first bracket part second arm and extending sufficiently to prevent sliding release from said grooves; and a selectively releasable means threaded within the opening of the second bracket part closer to the first bracket part first arm.

* * * * *